US006194369B1

(12) United States Patent
Eberhardt et al.

(10) Patent No.: US 6,194,369 B1
(45) Date of Patent: Feb. 27, 2001

(54) PICKLING/ACTIVATION SOLUTION FOR THE PRETREATMENT OF ALUMINUM-STEEL COMPOSITES PRIOR TO DIP TINNING

(75) Inventors: Jan Eberhardt, Munster; Dieter Guhl, Speyer; Frank Honselmann, Weingarten, all of (DE)

(73) Assignee: Th. Goldschmidt AG, Essen (DE)

( * ) Notice: Subject to any disclaimer, the term of this patent is extended or adjusted under 35 U.S.C. 154(b) by 0 days.

(21) Appl. No.: 09/340,004

(22) Filed: Jun. 25, 1999

(51) Int. Cl.[7] ..... C11D 3/22; C11D 14/02; C02F 5/10; C23F 14/02

(52) U.S. Cl. ..... 510/258; 510/245; 510/257; 510/259; 510/263; 510/269; 510/270

(58) Field of Search ..... 510/245, 253, 510/254, 257, 258, 259, 263, 266, 269, 270

(56) References Cited

U.S. PATENT DOCUMENTS 4,170,525 * 10/1979 Kirman et al. ..... 204/23
4,192,722 * 3/1980 Schardein et al. ..... 204/38 B
6,068,001 * 5/2000 Pedrazzini et al. ..... 134/3

FOREIGN PATENT DOCUMENTS 0 278 752 A1 8/1988 (EP) .

* cited by examiner

*Primary Examiner*—Yogendra Gupta
*Assistant Examiner*—John M Petruncio
(74) *Attorney, Agent, or Firm*—Scully, Scott, Murphy & Presser

(57) ABSTRACT

The invention relates to an aqueous preparation for the pickling and activation of aluminum-steel composites prior to electroless dip tinning. Specifically, the invention provides pickling/activation solutions for the pretreatment of aluminum-steel composites prior to dip tinning which comprise sulfuric acid, hexafluorosilicic acid, at least one wetting agent, at least one transition metal cation and nitrate and/or nitrite ions.

13 Claims, No Drawings

PICKLING/ACTIVATION SOLUTION FOR THE PRETREATMENT OF ALUMINUM-STEEL COMPOSITES PRIOR TO DIP TINNING

BACKGROUND OF THE INVENTION

1. Field of the Invention

The present invention relates to an aqueous preparation for the pickling and activation of aluminum-steel composites prior to electroless dip tinning. Examples of aluminum-steel composites are sliding bearings, bushes, wear disks, dry sliding bearings, etc., for pumps, motors and gear boxes. After pickling and activation, uniform, particularly strongly adhering tin coatings are obtained on the aluminum and steel surfaces of the substrate in a subsequent dip tinning process.

2. Prior Art

EP-A-0 278 752 discloses the tinning of substrates of aluminum alloys by an exchange method using acidic tin salt electrolytes after a pretreatment comprising degreasing and pickling.

Prior art systems comprising degreasing, pickling and tinning give unsatisfactory results when employed on substrates comprising aluminum-steel composites:

- the cleaning, pickling and tinning of the steel surfaces and the aluminum surfaces is non-uniform,
- the deposition of tin on the steel surfaces occurs non-uniformly and does not give a closed surface,
- the adhesion of the tin layer deposited on the aluminum is unsatisfactory.

SUMMARY OF THE INVENTION

The present invention therefore addresses the industrial problem of optimizing the pretreatment of an aluminum-steel composite. In particular, it is an object of the present invention to produce uniform, strongly adhering tin coatings both on the aluminum surfaces and on the steel surfaces of the substrate when using known dip tinning baths.

The abovementioned problem is solved according to the present invention by pretreatment of the substrate using a new pickling/activation solution comprising the following components and additives:

- sulfuric acid for pickling steel surfaces,
- hexafluorosilicic acid for pickling aluminum surfaces,
- surfactants for uniformly wetting the substrate surfaces with the solution,
- transition metal cations for optimizing the pickling and activation of the aluminum surface,
- nitrate and/or nitrite ions for optimizing the pickling and activation of the aluminum surface.

DETAILED DESCRIPTION OF THE INVENTION

In experiments on the pretreatment by pickling of aluminum-steel composites, applicants unexpectedly determined that a pickling/activation solution comprising sulfuric acid and hexafluorosilicic acid (with the contents of the two mineral acids in each case being matched to one of the two substrate alloys) was significantly more effective than other pretreatments. The sulfuric acid content in the pickling/activation solution of the present invention is preferably from 50 to 150 g/l. The hexafluorosilicic acid content in the inventive pickling/activation solution is preferably from 5 to 25 g/l.

Dilute sulfuric acid is suitable for pickling ferrous alloys but, at temperatures of up to 70° C. and dipping times of a few minutes, it does not attack aluminum to an appreciable extent. Hexafluorosilicic acid, on the other hand, cleans and activates aluminum alloys without significantly attacking iron surfaces. The combination of the two acids fulfills the requirements of a complex substrate structure comprising two alloys having widely different chemical and physical properties. Examples of aluminum-steel composites are sliding bearings, bushes, wear disks, dry sliding bearings, etc., which can be used for pumps, motors and gear boxes.

However, in order to achieve a uniform and strongly adhering tin deposit in the subsequent acidic, electroless dip tinning bath, further additives have to be added to this pickling/activation solution.

To achieve further optimization of the pickling action and, in particular, to achieve additional activation of the aluminum surfaces of the substrate, transition metal cations such as manganese(II), nickel(II) and iron(III) ions have to be added to the acid mixture in concentrations of from 0.05 to 1% by weight. A particularly advantageous effect is obtained using manganese(II) ions in a concentration of 0.1% by weight at a pickling temperature of 40° C. and a pickling time of 5 minutes.

Furthermore, the addition of nitrate and/or nitrite ions has been found to have a positive effect. Additions of alkali metal nitrate and alkali metal nitrite salts such as sodium nitrate, potassium nitrate, sodium nitrite or potassium nitrite in concentrations of from 0.05 to 3% by weight, with an addition of 0.5% by weight of potassium nitrate being optimum, significantly improve the pickling and cleaning results of the pickling/activation solution.

In addition, to achieve a uniform pickling/activation effect, uniform wetting of the surface is necessary. This is achieved in the present invention by addition of wetting agents to the pickling/activation solution. Suitable wetting agents employed in the present invention are essentially all surfactants which are capable of wetting the substrate, yet have sufficient chemical stability in the pickling/activation electrolyte. Particularly suitable wetting agents are those employed in dip tinning baths such as disclosed in EP-A-0 278 752. One example of a wetting agent is polyoxyethylene ether surfactants. The amount of wetting agents is preferably from 1 to 20 g/l.

The present invention accordingly provides aqueous pickling/activation solutions for the pretreatment of aluminum-steel composites prior to tinning in an acidic dip tinning bath, which solutions comprise sulfuric acid, hexafluorosilicic acid, at least one wetting agent, at least one transition metal cation and nitrate and/or nitrite ions. The inventive pickling/activation solutions prepare the substrate surface in such a way that a uniform, strongly adhering tin coating is subsequently obtained.

The amount of transition metal cations, which are, in particular, selected from Groups I, II and V to VIII of the Periodic Table of the Elements, is preferably from 0.05 to 1% by weight. The amount of nitrite ions is preferably from 0.05 to 3% by weight, while the amount of nitrate ions is preferably in the same range.

A further embodiment of the invention encompasses a process for the pickling and activation of aluminum-steel composites, which comprises bringing pickling/activation solutions of the present invention into contact with the composite for a time period of from 1 to 9 minutes at a temperature in the range from 15° to 70° C.

The following examples further illustrate the invention.

EXAMPLE 1

Substrates:

As test specimens, use was made of commercial aluminum-steel composite bearings. These are steel shells onto whose inner surface an aluminum alloy (about 80–90% of aluminum alloyed essentially with tin and silicon) has been roll-bonded.

Degreasing:

The substrates were degreased and rinsed in a manner known per se.

Pickling and Activation:

The substrates were dipped into the solution described below for 5 minutes. The temperature of the pickling solution was 40° C. After activation, the substrates were rinsed for one minute.

Solution 1:

100 g/l of $H_2SO_4$ 20 g/l of $H_2SiF_6$ 10 g/l of polyoxyethylene ether of decyl alcohol containing 5 oxyethylene units 5 g/l of $KNO_3$ 1 g/l of $MnSO_4$* 1 $H_2$ O

EXAMPLE 2

The procedure described in Example 1 was followed except that the following solution was employed.

Solution 2:

100 g/l of $H_2SO_4$ 20 g/l of $H_2SiF_6$ 10 g/l of polyoxyethylene ether of the hexyl alcohol silane $(CH_3)_3Si(CH_2)_6OH$ containing 4 oxyethylene units 5 g/l of $NaNO_2$ 1 g/l of $NiSO_4$* 6 $H_2O$

EXAMPLE 3

The procedure described in Example 1 was followed except that the following solution was employed.

Solution 3:

100 g/l of $H_2SO_4$ 20 g/l of $H_2SiF_6$ 10 g/l of polyoxyethylene ether of decyl alcohol containing 5 oxyethylene units 5 g/l of $NaNO_3$ 3 g/l of $Fe_2(SO_4)_3$*x $H_20$

COMPARATIVE EXAMPLE

The procedure described in Example 1 was followed except that the following solution was employed.

120 g/l of $HNO_3$ 20 g/l of $H_2SiF_6$ 5 g/l of polyoxyethylene ether of stearyl alcohol containing 20 oxyethylene units 2 g/l of gelatin

EXAMPLE 4

Tinning:

The substrates from Examples 1 to 3 and from the comparative example were each dipped for 5 minutes into commercial, acidic electroless dip tinning baths 1 to 3. Tinning was carried out at 30–40° C.

Dip Tinning Bath 1:

100 g/l of $H_2SO_4$ 40 g/l of $SnSO_4$ 3.5 g/l of $HBF_4$ 2 g/l of gelatin 1 g/l of polyoxyethylene ether of decyl alcohol containing 5 oxyethylene units Dip Tinning Bath 2:

100 g/l of $H_2SO_4$ 40 g/l of $SnSO_4$ 7 g/l of $KBF_4$ 2 g/l of gelatin 0.1 g/l of polyoxyethylene ether of stearyl alcohol containing 20 oxyethylene units Dip Tinning Bath 3:

100 g/l of $CH_3SO_3H$ 30 g/l of $(CH_3SO_3)_2Sn$ 2 g/l of $H_2SiF_6$ 1 g/l of gelatin 0.1 g/l of polyoxyethylene ether of the hexyl alcohol silane $(CH_3)_3Si(CH_2)_6$ OH containing 4 oxyethylene units Tinning Results:

After pickling and activation using solution 1, solution 2 or solution 3, uniform, smooth, closed and very strongly adhering tin layers were deposited on steel and aluminum surfaces in dip tinning bath, 1, 2 or 3. The thicknesses of the tin coatings were from 1.8 to 4.2 $\mu$m on aluminum surfaces and from 0.4 to 0.8 $\mu$m on the steel surfaces. To test the adhesion, a strip of transparent adhesive tape (Tesa®) was stuck onto the tinned substrate surface and, with the aid of a pencil, pressed on as hard as possible and then pulled off with a jerk at an angle of 450°. In all three cases, no tin was detached. The tin layers after the test again had thicknesses of from 1.8 to 4.2 $\mu$m on aluminum surfaces and from 0.4 to 0.8 $\mu$m on the steel surfaces.

COMPARATIVE EXAMPLE:

Pickling by means of the nitric acid pretreatment resulted in strong attack on the iron surfaces. Subsequent dip tinning using dip tinning bath 1, 2 or 3 gave non-uniform tin deposits on the substrate surfaces. Moreover, the iron surface did not have a closed tin coating. The adhesion was tested as described above. The adhesive tape test resulted in significant detachment of tin from the aluminum surface. The thickness of the tin layer on the aluminum alloy was from 1.8 to 4.2 $\mu$m before the test and only from 0.2 to 0.5 $\mu$m after the test.

TABLE

| | Tinning bath 1 | Tinning bath 2 | Tinning bath 3 |
|---|---|---|---|
| Solution 1 | very good tin deposit, excellent adhesion | very good tin deposit, excellent adhesion | good tin deposit, very good adhesion |
| Solution 2 | very good tin deposit, very good adhesion | very good tin deposit, very good adhesion | good tin deposit, very good adhesion |

TABLE-continued

| | Tinning bath 1 | Tinning bath 2 | Tinning bath 3 |
|---|---|---|---|
| Solution 3 | very good tin deposit, very good adhesion | very good tin deposit, very good adhesion | very good tin deposit, very good adhesion |
| Comparative example | nonuniform tin deposit, poor adhesion | nonuniform tin deposit, poor adhesion | very nonuniform tin deposit, poor adhesion |

While the present invention has been particularly shown and described with respect to preferred embodiments thereof, it will be understood by those skilled in the art that the foregoing and other changes in form and detail may be made without departing from the spirit and scope of the present invention. It is therefore intended that the present invention not be limited to the exact forms described and illustrated but fall within the scope of the appended claims.

What we claim is:

1. A pickling/activation solution for the pretreatment of aluminum-steel composites prior to dip tinning, said solution comprising sulfuric acid, hexafluorosilicic acid, at least one wetting agent, at least one transition metal cation and nitrate and/or nitrite ions.

2. The solution according to claim 1, wherein the sulfuric acid is present in a concentration of from 50 to 150 g/l.

3. The solution according to claim 1, wherein the hexafluorosilicic acid is present in a concentration of from 5 to 25 g/l.

4. The solution according to claim 1, wherein the wetting agent is present in a concentration of from 1 to 20 g/l.

5. The solution according to claim 1, wherein the wetting agent is a polyoxyethylene ether surfactant.

6. The solution according to claim 1, wherein the transition metal cation is present in a concentration of from 0.05 to 1% by weight.

7. The solution according to claim 1, wherein the transition metal cation is a metal selected from Groups I, II and V to VIII of the Periodic Table of Elements.

8. The solution according to claim 1, wherein the nitrite ion is present in a concentration of from 0.05 to 3% by weight.

9. The solution according to claim 1, wherein the nitrate ion is present in a concentration of from 0.05 to 3% by weight.

10. The solution according to claim 1 comprising $H_2SO_4$; $H_2SiF_6$; a polyoxyethylene ether of decyl alcohol containing 5 oxyethylene units; $KNO_3$ and $MnSO_4$.

11. The solution according to claim 1 comprising $H_2SO_4$; $H_2SiF_6$; a polyoxyethylene ether of a hexyl alcohol silane containing 4 oxyethylene units; $NaNO_2$ and $NiSO_4$.

12. The solution according to claim 1 comprising $H_2SO_4$; $H_2SiF_6$; a polyoxyethylene ether of decyl alcohol containing 5 oxyethylene units; $NaNO_3$ and $Fe_2(SO_4)_3$.

13. A process for the pickling and activation of aluminum-steel composites, which comprises bringing a pickling/activation solution as claimed in claim 1 into contact with a composite for a time period of from 1 to 9 minutes and at a temperature in the range of from 15° to 70° C.

* * * * *

UNITED STATES PATENT AND TRADEMARK OFFICE

CERTIFICATE OF CORRECTION

PATENT NO. : 6,194,369 B1
DATED : February 27, 2001
INVENTOR(S) : J. Eberhardt et al.

It is certified that error appears in the above-identified patent and that said Letters Patent is hereby corrected as shown below:

Title page,
Item [30], insert:
-- [30] Foreign Priority Data
(DE) 198 28 811.5…….June 27, 1998 --

Signed and Sealed this

Seventeenth Day of September, 2002

*Attest:*

*Attesting Officer*

JAMES E. ROGAN
*Director of the United States Patent and Trademark Office*